US005185939A

United States Patent [19]

Kimura

[11] Patent Number: 5,185,939

[45] Date of Patent: Feb. 16, 1993

[54] APPARATUS FOR DRYING RUBBER BOOTS AND OTHER ITEMS

[76] Inventor: Takayuki Kimura, 3307, Watari-cho, Sakaiminato City, Tottori, 684, Japan

[21] Appl. No.: 765,850

[22] Filed: Sep. 26, 1991

[30] Foreign Application Priority Data

Oct. 2, 1990 [JP] Japan ..... 2-104376

[51] Int. Cl.[5] ..... F26B 25/00

[52] U.S. Cl. ..... 34/105; 422/300; 422/28; 34/211; 34/212; 34/225

[58] Field of Search ..... 34/104, 105, 106, 211, 34/209, 210, 213, 214, 218, 219, 224, 225, 233, 202; 422/28, 5, 26, 292, 124, 125, 300

[56] References Cited

U.S. PATENT DOCUMENTS

| | | | |
|---|---|---|---|
| 11,460 | 12/1894 | Proctor | 34/103 |
| 1,488,433 | 3/1924 | MacDonald | 34/202 |
| 2,788,586 | 4/1957 | London | 34/211 |
| 2,977,647 | 4/1961 | Vassiliades et al. | 422/300 |
| 3,078,526 | 2/1963 | Caruso | 422/300 |
| 3,793,744 | 2/1974 | Saita | 422/300 |
| 3,828,588 | 8/1974 | Duncan | 34/211 |
| 4,625,432 | 12/1986 | Baltes | 34/225 |
| 4,715,129 | 12/1987 | Uchida | 34/224 |
| 4,908,957 | 3/1990 | Acosta, Sr. et al. | 34/86 |

*Primary Examiner*—Henry A. Bennet
*Assistant Examiner*—Denise L. F. Gromada
*Attorney, Agent, or Firm*—Joseph C. Mason, Jr.; Ronald E. Smith

[57] ABSTRACT

A drying apparatus for rubber boots and other items comprising hollow housing equipment with open front and rear surfaces, disinfectant spraying equipment a low-temperature dehumidifier connected in free communication with the housing equipment, wherein the housing equipment is partitioned into rows and columns of housing boxes by partition frames and has its bottom surface designed to serve as slit shelves so that the drying apparatus for rubber boots and other items can dry, in particular, rubber boots used at work, or outfits such as golf bags and ski wears at low temperature, which does not damage the material, by forcible air convection and the disinfectant is carried on the air stream and distributed throughout the housing equipment to perform sanitary drying and dehumidification.

17 Claims, 10 Drawing Sheets

APPARATUS FOR DRYING RUBBER BOOTS AND OTHER ITEMS

FIELD OF THE INVENTION

The present invention relates to a drying apparatus for rubber boots and others which can dry rubber boots used at work, or other outfits such as golf bags and ski wears easily and securely at low temperature which does not damage the material, as well as to carry out hot air drying or disinfectant spraying as required.

In this specification, low temperature means temperature that does not deteriorate or damage generally used rubber boots by heat, more specifically, temperature lower than about 40° C.

OBJECTIVES OF THE INVENTION

The present invention has been made to achieve the following objectives.

That is, the invented drying apparatus can accommodate rubber boots damped with moisture such as sweat, etc. in a housing box in the housing equipment and easily and securely dry at low temperature that does not damage the material, enabling workers to readily wear dry rubber boots and work comfortably.

Moreover, a disinfectant sprayer installed can disinfect rubber boots surely, enabling the thoroughgoing hygienic control.

If freely operated doors are provided on the front and rear surfaces of the housing box of this drying apparatus for rubber boots and others, such as boots can be got in and out from both sides. This arrangement allows unsaitary and damp rubber boots after work to be got in and out separately, enabling the thoroughgoing hygienic control.

Furthermore, air-supply and air-suction fans are installed at both sides of the housing equipment and circulate the air stream forcibly for each horizontal row, achieving more secure and more effective drying.

Prior Arts

As in the past, in factories of various fields including the food industry which are required to carry out hygienic control, workers must wear special-purpose rubber boots while they are at work from the viewpoint of hygienic control.

These special-purpose rubber boots tend to be damped with sweat from workers at work, and wearing such rubber boots would give unpleasant feeling and distress to workers.

In particular, in food factories where a large amount of water is used or factories where workers must work under the environment to contaminate workers, rubber boots are frequently used as dedicated rubber boots, which are damped with sweat during work and the moisture from the sweat is neither discharged, keeping the boots inside in wetter condition.

Moreover, the same rubber boots are used every day. They hardly dry completely in the next day after completion of work and are kept always in the wet condition. Such rubber boots do not absorb moisture such as sweat but only moisten workers, giving distress to them.

Furthermore, rubber boots held in the damp condition not only give distress to workers but also provide a good environment for bacteria to increase, producing unsanitary conditions. This constitutes a serious problem from the viewpoint of hygenic control of factories.

As described above, rubber boots held in the damp conditions give distress to workers and cause to produce an unsanitary environment which enhances the bacteria increase. Therefore, various types of equipment have been developed to dry rubber boots.

Examples of the equipment to dry rubber boots include the "Boots Dryer" of Japanese Utility Model Unexamined Publication No. hei 1-160966.

The "Boots Dryer," the side surface of which is shown in FIG. 16, comprising a warm air generator (B) which consists of a heating unit (B-1) and a fan (B-2) located below a box (A), a centralized duct (C) connected to this warm air generator (B), a multiplicity of a branch duct (C-1) provided with vent holes branching from this centralized duct (C), and boots hangers with a multiplicity of vent holes connected to the tip end of this branch duct (C-1).

In the boots hanger formed with this configuration, damped boots after work are inverted and put over the boots hanger (D) as illustrated, and the warm air generator is operated to blow warm air into boots via centralized duct (C) and branch duct (C-1) so that the boot inside is forcibly dried.

In the meantime, a "Shoes Dryer" is disclosed in Japanese Patent Unexamined Publication No. sho 58-49745.

This equipment comprises a main duct (F) to supply warm air installed to the back plate side of the box-form dryer proper (E) as shown in FIGS. 17 and 18, and shelf boards (H) with a shelf board duct (G) with an air outlet (K) fixed to the rear surface, which are removably installed to the dryer proper (E).

In this type of "shoe dryer," boots are placed on the shelf board (H), an warm air generator (I) is operated, and the generated air is blown up through the outlet (K) via the shelf board duct (G) from the main duct (F) to dry shoes with warm air heat and wind.

However, in the above-mentioned "Boots Dryer" damp high boots are put on a boots hanger (D) one boot for one boots hanger, inevitably restricting the number of boots which can be dried in one operation and preventing a large number of high boots from being dried simultaneously.

The "Shoes Dryer" of the Japanese Patent Unexamine Publication No. sho 58-49745 can solve the problem of limited number of dried shoes but because heat and wind generated by an warm water generator (I) is used for a drying means, repeated heating may deteriorate heat resistance of rubber-based resin when the surface of the rubber boots is formed with materials easily susceptible to heat or causes the plasticizer to float up onto the surface and damages the material of rubber boots themselves, depending on temperature of the warm air.

DETAILED DESCRIPTION OF THIS INVENTION

Figure 1:
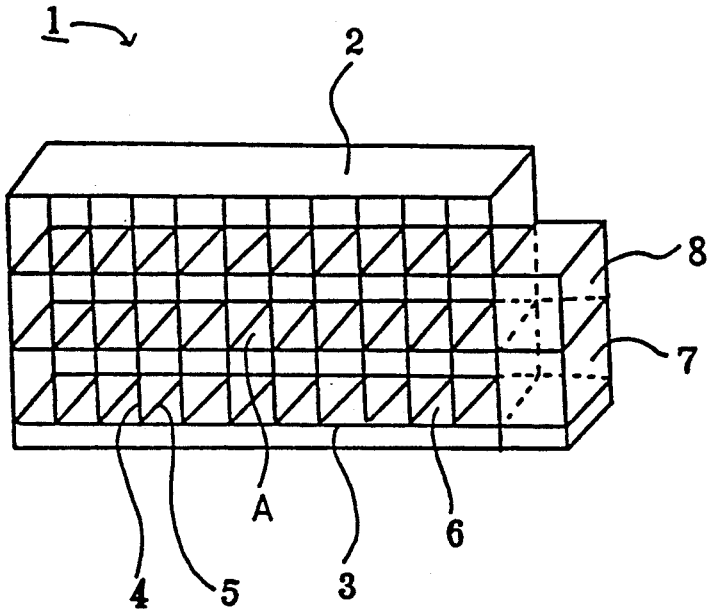
FIG. 1 is a schematic representation showing a drying apparatus for rubber boots and others related to the first embodiment of the present invention.

Referring now to the preferred embodiments, the present invention will be described in detail hereinafter. FIG. 1 is a schematic representation showing a drying apparatus for rubber boots and others related to the first embodiment of the present invention. In the drawing, (1) is a drying apparatus for rubber boots and others, (2) is a housing equipment, (3) is a X-axis partition frame, (4) is a Y-axis partition frame, (5) is a Z-axis partition frame, (6) is a housing box, (7) is a low-temperature dehumidifier, and (8) is a disinfectant spraying equipment.

The housing equipment (2) of the drying apparatus for rubber boots and others (1) related to this invention has a square shape and is a hollow housing equipment (2) with its front and rear surfaces are open.

On these open front and rear surfaces of this housing equipment, X-axis partition frame (3) and Y-axis partition frame (4) are formed, respectively, and the partition frames formed on the front and rear surfaces, respectively, are connected by the Z-axis partition frame (5) to divide into a housing box (6).

In this first embodiment, a housing equipment is divided into a housing box (6) with three layers per one row.

This housing box (6) may be divided in one row and may have one or a multiplicity of layers.

This is to carry out hygienic control more thoroughly as a housing box (6) that enables rubber boots to be got in and out from both front and rear surfaces as described more in detail in the usage later on.

The details of this housing box (6), which will be described in FIG. 2 later on, is a housing box (6) partitioned to accommodate rubber boots and others. The front and rear surfaces of these individual housing boxes (6) are equipped with glass doors, which can be opened and closed freely, enabling the free entry and removal of the rubber boots and others to and from the front and rear surfaces.

With respect to surfaces other than the front and rear ones, to the bottom surfaces, only slits are formed to place rubber boots and others, and adjoining housing boxes (6) are designed to be in free communication with one another to allow air to circulate in the housing equipment (2).

The housing equipment (2) is connected in free communication with the low-temperature dehumidifier (7).

The dehumidifier (7) is installed to dry rubber boots and others stored in each housing box (6) and sucks air in the housing equipment to remove moisture, thereby drying rubber boots and others.

The details of the dehumidifier (7) will be described later.

Furthermore, in this invention, the housing equipment (2) is connected in free communication with the disinfectant spraying equipment (8).

The disinfectant spraying equipment (8) sprays the disinfectant with a compressor. The atomized disinfectant diffuses in the housing equipment (2) by its dead weight and disinfects rubber boots and others. The details will be described later referring to FIG. 3.

Figure 2:
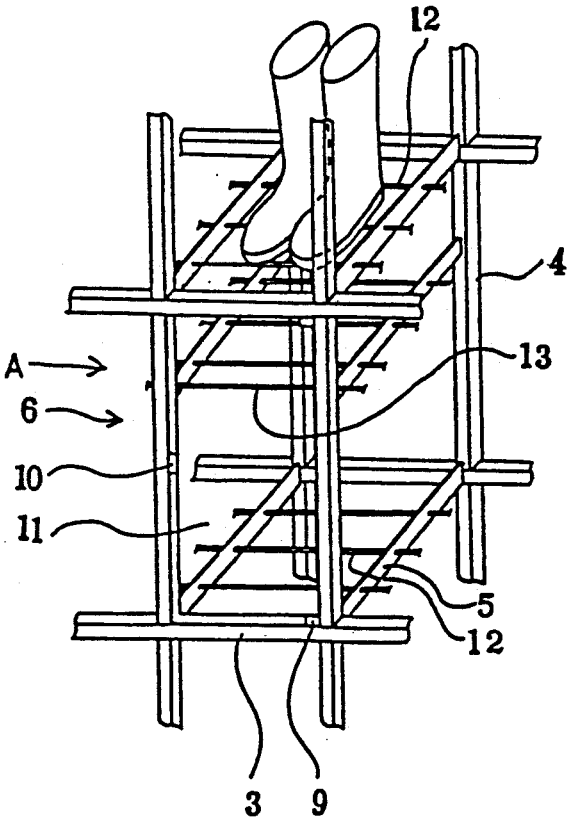
FIG. 2 is a view as seen obliquely, showing a housing box formed at the position A of FIG. 1.

FIG. 2 is a view as seen obliquely, showing a housing box formed at the position A of FIG. 1.

The front surface consisting of X-axis partition frame (3) and Y-axis partition frame (4) of the housing box (6) is connected with hinges for glass (9) and magnet (10) to enable the free opening and closing of a glass door (11) as illustrated.

The rear surface is configured in the similar manner as the front surface and is designed to get in and out the rubber boots.

To the bottom and top surfaces of the housing box (6), slit shelves (12) are formed by metal bars inserted between Z-axis partition frames (5).

That is, the top and bottom surfaces of the housing box (6) (bottom surface for the housing box (6) located above (A)) have slit shelves (12) provided to place rubber boots.

In this embodiment, no slit shelves are formed on the side to achieve better air circulation.

Furthermore, this housing box (6) is provided with split slit shelves (13) as illustrated to split upper and lower layers.

On this upper layer, low shoes such as canvas shoes and slippers are designed to be stored and on the lower layer, high boots are designed to be stored.

Figure 3:
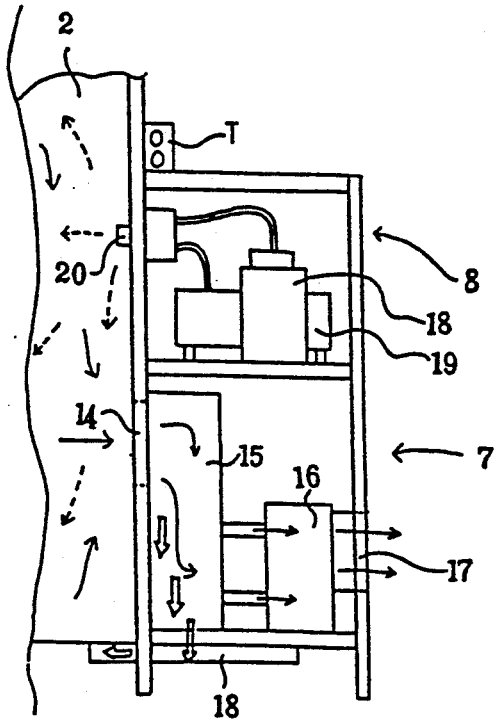
FIG. 3 shows a casing as seen from the side surface of the dehumifier and disinfectant spraying equipment.

FIG. 3 shows a casing inside as seen from the side surface of the dehumifier (7) and disinfectant spraying equipment (8).

At the lower layer, a low-temperature dehumidifier (7) is installed and at the upper layer a disinfectant spraying equipment is installed.

The dehumidifier (7) is connected in free communication with the housing equipment (2) via an opening; to this opening (14) a condenser (15) is connected; the condenser (15) is connected in free communication with a suction fan (16); and this suction fan (16) communicates freely with the outside via an exhaust port (17).

Below the condenser (15), water drainage (18) is installed.

In the low-temperature dehumidifier (7) with this configuration, air containing moisture in the housing equipment (2) is sucked with the suction fan (16) from the opening (14) and discharged from the discharge port (17).

In such event, moisture is condensed by the condenser (15) connected in free communication with the opening and discharged as water from the water drainage (17) as shown with bold arrows to dehumidify the housing equipment (2) inside.

The reason why this dehumidifier (7) is kept to low temperature is to prevent high-temperature damage to rubber boots.

In the drying apparatus for rubber boots and others of the present invention, it is recommended that the housing equipment (2) inside generally be kept below room temperature, and the temperature is kept to 20°-40° C. during the spring, summer, and fall and to 20°-30° C. in the wintertime by heating, more desirably to the low-temperature zone of 23°-27° C.

This is because when temperature inside the housing equipment (2) exceeds 40° C., repeated drying tends to deteriorate rubber boots and, in view of this plus to dehumidify and dry the housing equipment (2) inside, setting the dehumidifier temperature to the 23°-27° C. range achieves the best drying efficiency from the relationship between water and steam.

The dehumidifier (7) is operated under the control of the timer switch (T).

The disinfectant spraying equipment (8) comprises a disinfectant container (18), a compressor (19), and an injection nozzle (20). This disinfectant spraying equipment (8) is also operated under the control of a timer switch (T) and is initialized separately from the dehumidifier (7) to control and operate the compressor (19), discharges disinfectant contained in the disinfectant container (18) as shown with dotted arrow marks, circulates the disinfectant through each housing box (6) and disinfects rubber boots and others.

Next, discussion will be made on how to use the drying apparatus for rubber boots and others with this configuration.

Figure 4:
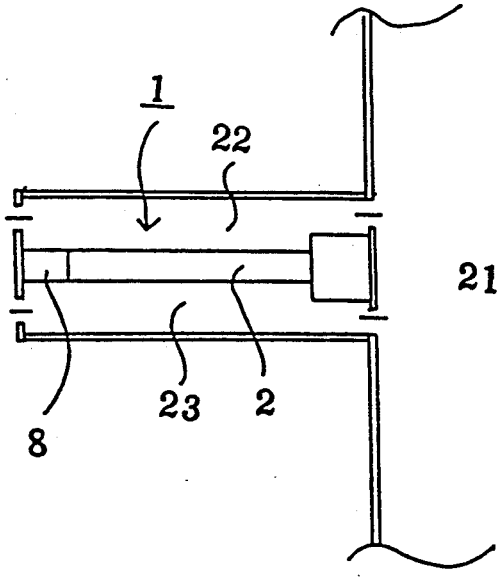
FIG. 4 is a plan showing a drying apparatus for rubber boots and others relted to the second embodiment according to the present invention.

FIG. 4 is a plan showing a drying apparatus for rubber boots and others relted to the present invention installed in a plant.

As shown in FIG. 4, this drying apparatus for rubber boots and others (1) is installed in an aisle provided between a workshop (21) and a doorway separating the entrance (22) and the exit (23) to and from the workshop as illustrated.

Workers take out rubber boots from the glass door on the front surface of the housing box (6) installed on the entrance side (22) before entering the workshop, wear rubber boots, enter the workshop, and carry out their jobs.

Upon completion of work, they come out from the exit (23) and houses damped and unsanitary rubber boots which are likely to increase bacteria in the housing box (6) through the glass do or of the rear surface of the housing box (6).

The rubber boots stored in the housing box (6) are dried and disinfected by the dehumidifier (7) and the disinfectant spraying equipment (8) as described above until they are used again in the following day.

The housing box (6) is installed in such a manner that the rubber boots are put in and taken out separately, preventing any chance of contaminating the dried and disinfected rubber boots before work with unsanitary rubber boots after work.

In this embodiment, glass plates are used to build transparent freely operated doors on the front and rear surfaces of the housing box (6), but the present invention only requires a freely operable door provided on the front surface (not necessarily transparent), and either freely oprable door or fixed plate for the rear surface. They can be freely selected according to conditions.

Figure 5:
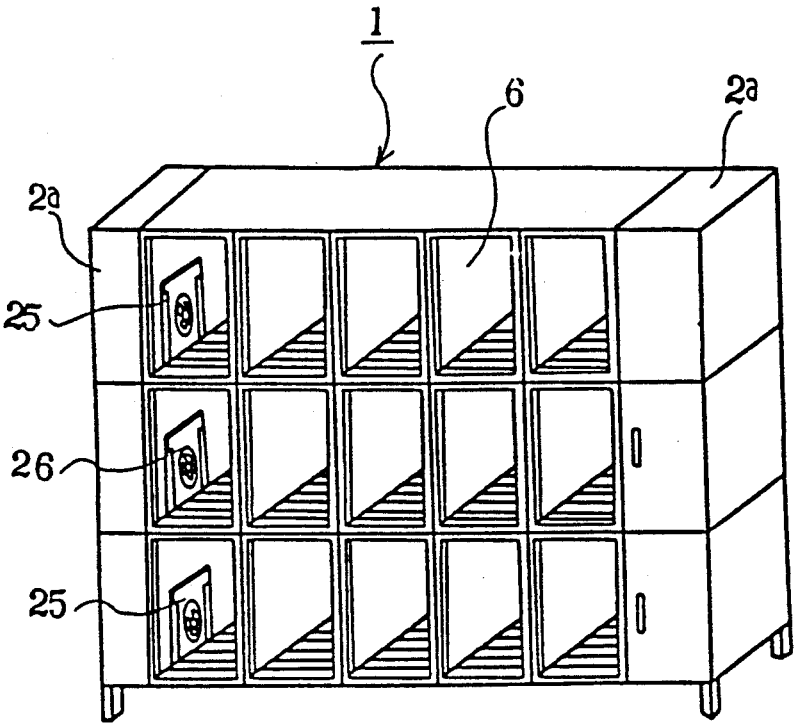
FIG. 5 is a schematic representation showing a drying apparatus for rubber boots and others related to the second embodiment of the present invention.

FIG. 5 is a schematic representation showing a drying apparatus for rubber boots and others (1) of the second embodiment related to the present invention. In the second embodiment illustrated, hollow air passage sections (2*a*), (2*a*) are equipped to both sides of the housing equipment (2).

In this second embodiment, on both sides of the housing box (6) in the X direction, air supply fans (25) and suction fans (26) are installed opposite each other alternately.

Consequently, in the abovementioned first embodiment, moisture generated by rubber boots in the housing equipment (2) are dried only by suction by the low-temperature dehumidifier (7) but in this second embodiment, by the air supply fans (25) and air suction fans (26) installed oppositely, the air stream according to horizontal rows arranged in parallel in partition frames is forcibly circulated by convection.

Figure 6:
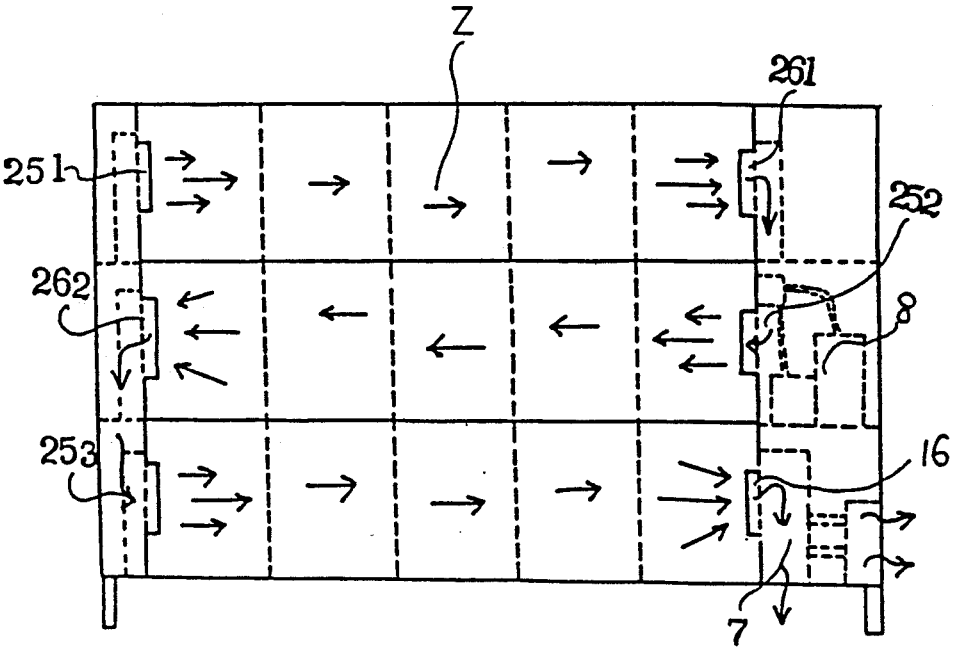
FIG. 6 is a typical arrangement showing a air circulation of the second embodiment of the present invention.

This convection is shown in FIG. 6. First of all, air is forcibly fed in the horizontal row direction by the first air supply fan (251) and the forced supply air is forcibly sucked by the first suction fan (261) installed oppositely on the same row.

The air stream (Z) sucked by the first suction fan (261) is allowed to flow into a hollow air passage section (2*a*), then circulated to the second air supply fan (252).

The circulated air stream is forcibly fed further to the horizontal direction by the second air supply fan (252) and this air stream is forcibly sucked by the second suction fan (262) and introduced into the hollow air passage section (2*a*) for circulation.

In this way, the air stream (Z) which is forcibly circulated by convection repeating forced air supply, forced suction, etc. via air passage sections (2*a*), (2*a*) provided on both sides of the housing equipment (2) is eventually sucked to the low-temperature dehumidifier (7) installed to the lowermost layer via the suction fan (16) and discharged.

Consequently, in the second embodiment, air in the housing equipment (2) is forcibly circulated by convection, enabling more effective drying and dehumidification of rubber boots and others.

Figure 7:
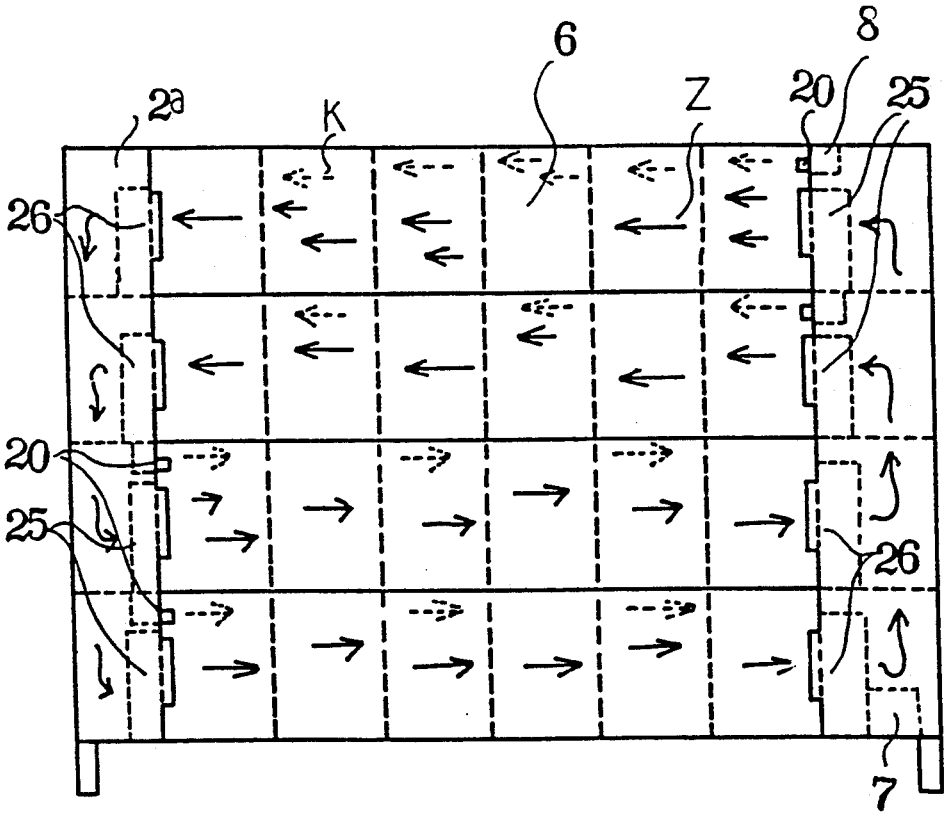
FIG. 7 is a typical arrangement showing a modification example of the second embodiment of the present invention.

This second embodiment shall not be limited by FIG. 5 and FIG. 6, but may be partitioned, for example, into a housing box (6) with one row in four layers as shown in FIG. 7.

In this modified example, on both sides of the housing box in the X direction, air supply fans (25) and suction fans (26) are installed oppositely so that the direction of the air stream may be changed every two layers, and in the vicinity of the air supply fan (25), an injection nozzle (20) in free communication with the disinfectant spraying equipment (8) is installed.

As illustrated, because installation of the air supply fan (25) and the disinfectant injection nozzle (20) forcibly circulates the air stream (Z) or disinfectant (K) by convection every horizontal row arranged in parallel by the partition frames, the spraying conditions of disinfectant fines can be visually observed, ensuring the effective distribution of the disinfectant fines in the housing box (6) and increasing the disinfection effects.

By the way, in this invention, operation of the air supply fan (25) is stopped while the disinfectant is being sprayed.

In this embodiment, air from which moisture is removed by the dehumidifier (7) is further circulated by the air passage section (2a) on the side.

In this invention, air from which moisture is removed by the dehumidifier (7) may further be circulated by the air passage section (2a) on the side as in this embodiment or may be discharged to the outside of the drying apparatus for rubber boots and others as in the first embodiment.

Figure 8:
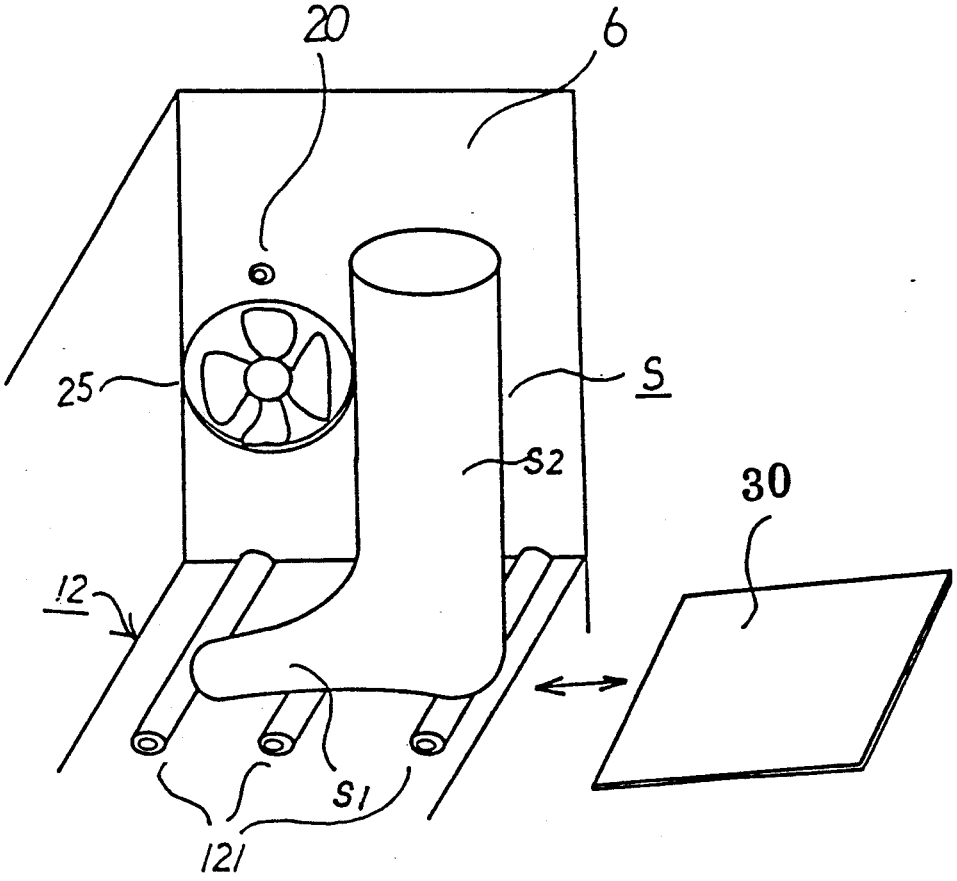
FIG. 8 is a schematic representation showing an inside of the housing box related to the present invention.
Figure 9:
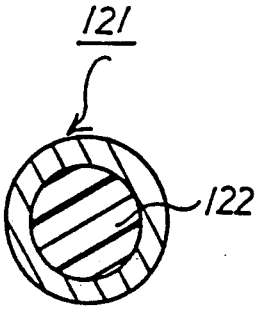
FIG. 9 is a cutaway view of a metal bar composing slit shelf related to one embodiment of this invention.

Furthermore, in this invention, the air supply fan (25) on both sides of the housing box (6) in the X-axis direction and the disinfectant injection nozzle (20) are located above the instep section (S1) and ahead of the calf section (S2) of a rubber boots (S) placed on the slit shelves (12) as shown in FIG. 8.

Installing the air supply fan (25) and disinfectant injection nozzle (20) at a specific position in this way circulates air or disinfectant in the housing box by convection without permitting rubber boots (S) to impede the air stream when boots are placed in the housing box (6) with the toes placed neatly side by side.

In this invention, the slit shelves (12) on the bottom surface of the housing box (6) are designed to accommodate a removable bottom plate (30) as shown in FIG. 8.

When muddy rubber boots are dried in the housing box (6), mud adhering to the boot soles fall onto the housing box (6) on the lower layer via slit shelves (12). This can be prevented by fitting a bottom plate (30) to the slit shelves.

In this invention, copper tube heater wire (122) may be embedded in the metal bars (121) which form slit shelves (12). Embedding copper tube heater wire (122) in the slit shelves (12) in this way easily keeps temperature inside the housing box (6) to a specified range only by operating a switch (not illustrated) installed to the drying apparatus for rubber boots and others (1) when temperature in the housing box (6) cannot be kept in the range of 20°-30° C., for example, when room temperature lowers excessively in the wintertime.

Figure 10:
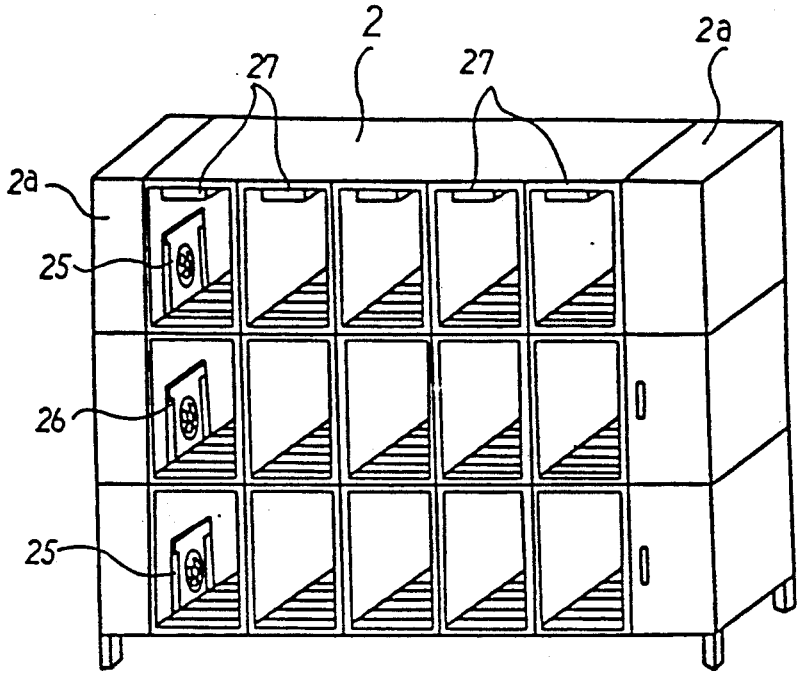
FIG. 10 is a schematic representation showing the drying apparatus for rubber boots and others related to the third embodiment of the present invention.
Figure 11:
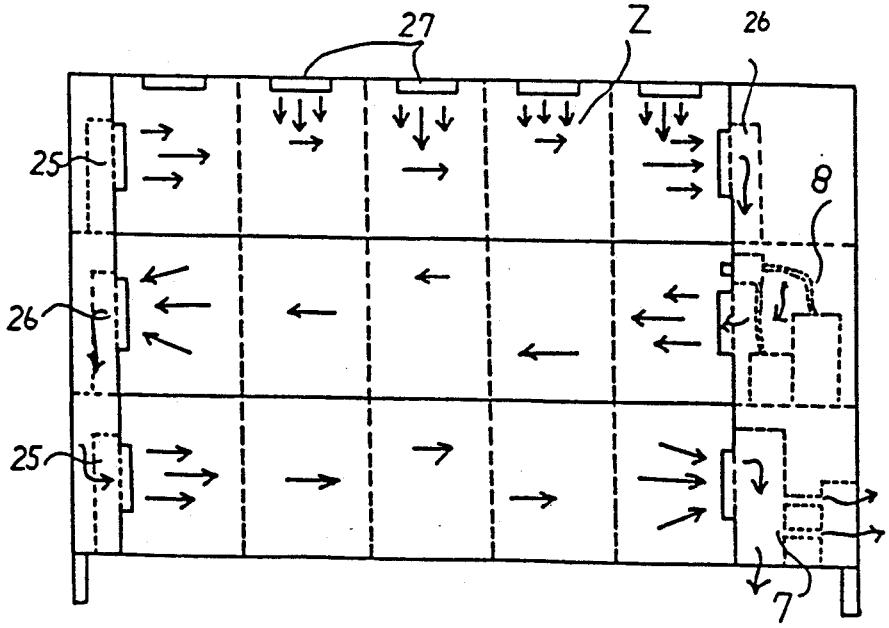
FIG. 11 is a typical arrangement showing an air circulation of the third embodiment of the present invention.

FIG. 10 is a schematic representation showing the drying apparatus for rubber boots and others related to the third embodiment of the present invention.

In this third embodiment, the air stream (Z) in the drying apparatus for rubber boots and others (1) can circulate air forcibly in the longitudinal direction by convection with the air supply fan (27) installed to the top end for further effective drying and dehumidification in addition to the forced air convection in the horizontal direction shown in the embodiment mentioned above.

In this third embodiment illustrated, the air supply fan (27) is installed to the top end but this invention shall not be limited to this but the air supply fan can be installed at any place.

Figure 12:
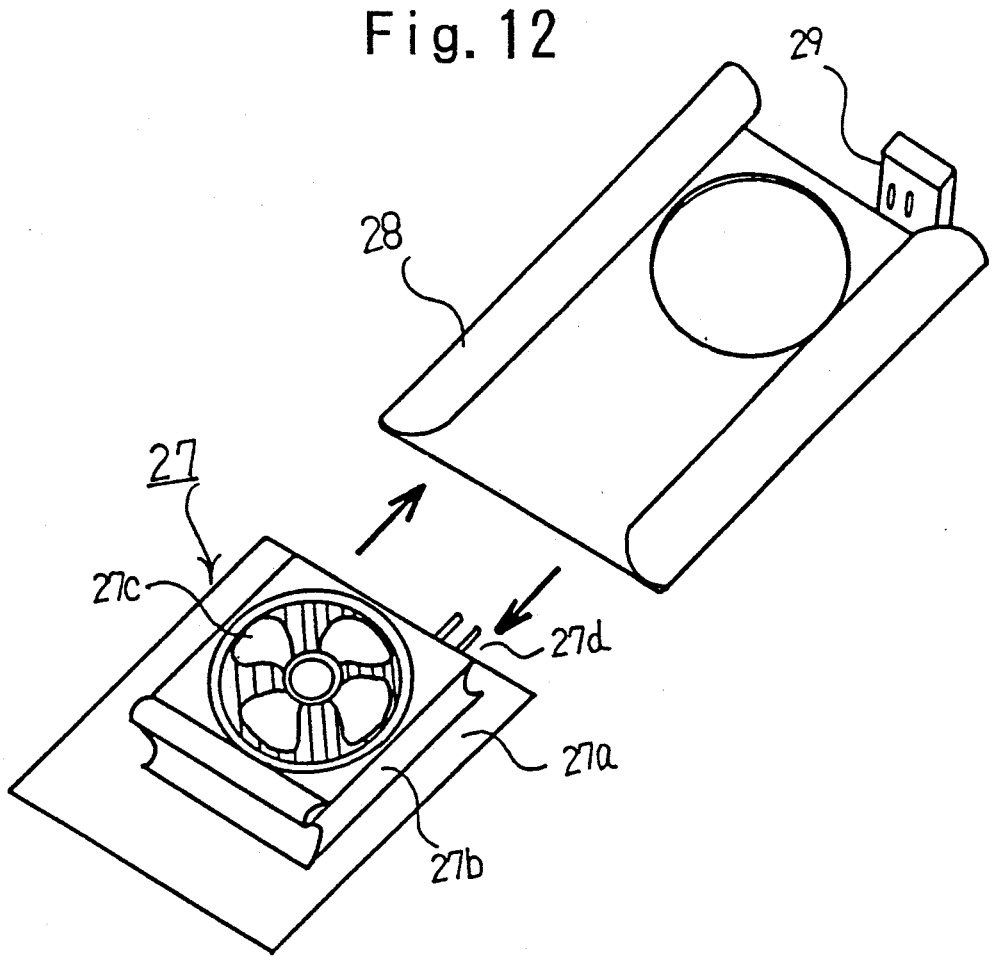
FIG. 12 is a disassembly drawing of an air supply fan related to the third embodiment of the present invention.
Figure 13:
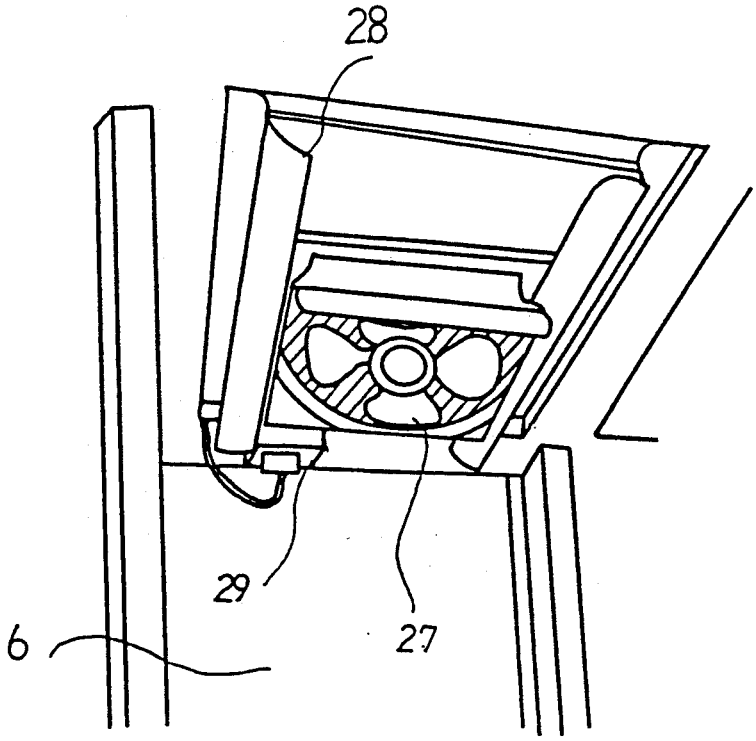
FIG. 13 is an enlarged view of the air supply fan shown in FIG. 12.

The air supply fan (27) in this embodiment consists of a slide member (27a) and a box (27b) installed on a slide member (27a) as the disassembly drawing of FIG. 12 shows; in the box (27b), a drive (not illustrated) and an air supply fan (27c) are contained and an attachment plug (27d) connected to the drive is extruded outside.

On the other hand, in this third embodiment, a guide member (28), along which both ends of a slide member (27a) of the air supply fan (27) slide, and a power supply receptacle (29) are installed.

In the third embodiment with the above configuration, the air supply fan (27) is installed removably via the slide between the guide member (28) and the slide member (27a) equipped in the housing equipment (2).

The installed air supply fan (27) is electrically driven by connecting the attachment plug (27d) and the power supply receptacle (29) and freely turned ON/OFF by a switch (not illustrated) installed outside the drying apparatus for rubber boots (1).

Figure 14:
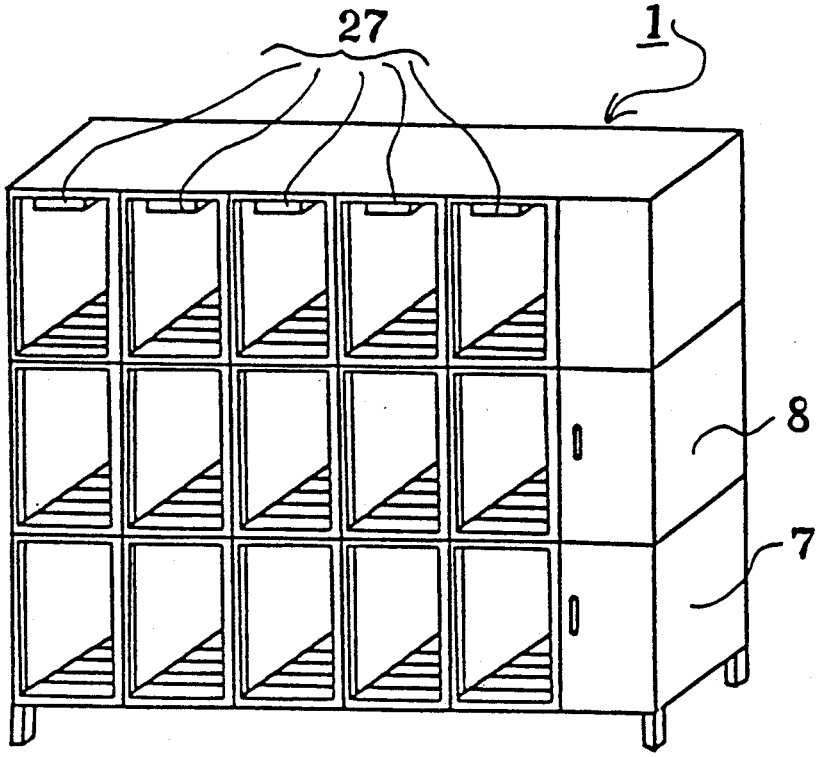
FIG. 14 is a schematic representation showing other embodiment of a drying apparatus for rubber boots and others related to the third embodiment of this invention.

FIG. 14 is a schematic representation showing other modified example of the third embodiment.

The third embodiment according to this invention only requires a removable air supply fan (27) to be installed in the housing equipment (2). As shown in FIG. 14, it may be installed at the top end of the drying apparatus for rubber boots and others (1) shown in the above first embodiment.

Figure 15:
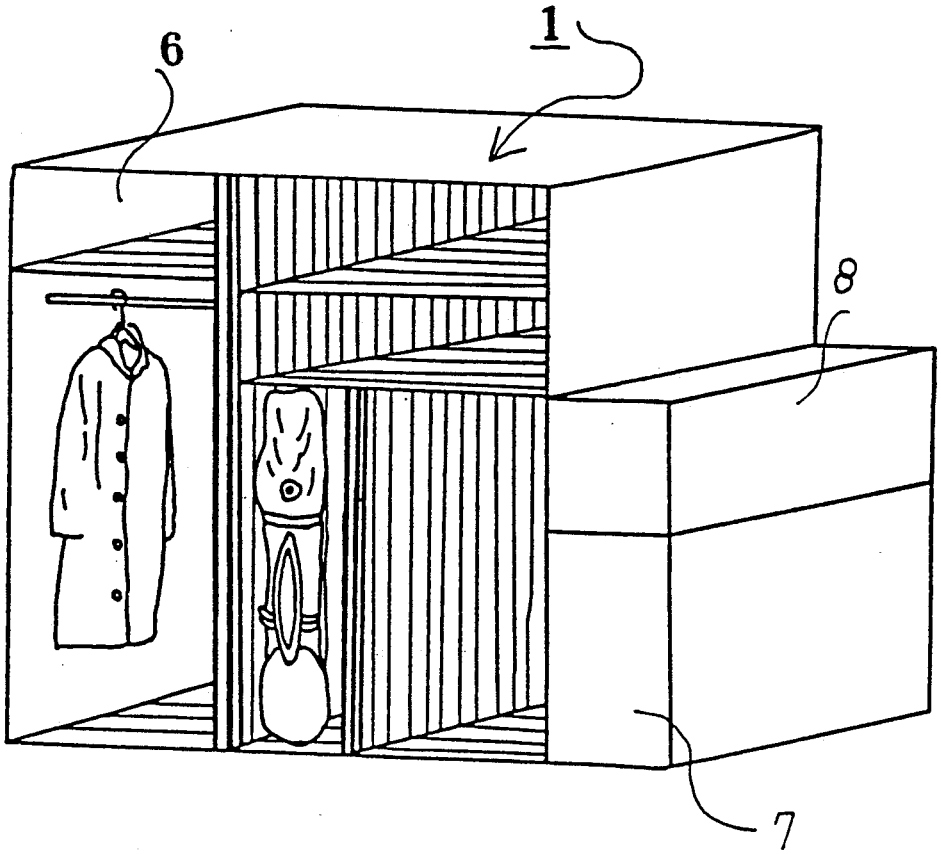
FIG. 15 is a view as seen obliquely, showing a drying apparatus for rubber boots and others related to the fourth embodiment of this invention.
Figure 16:
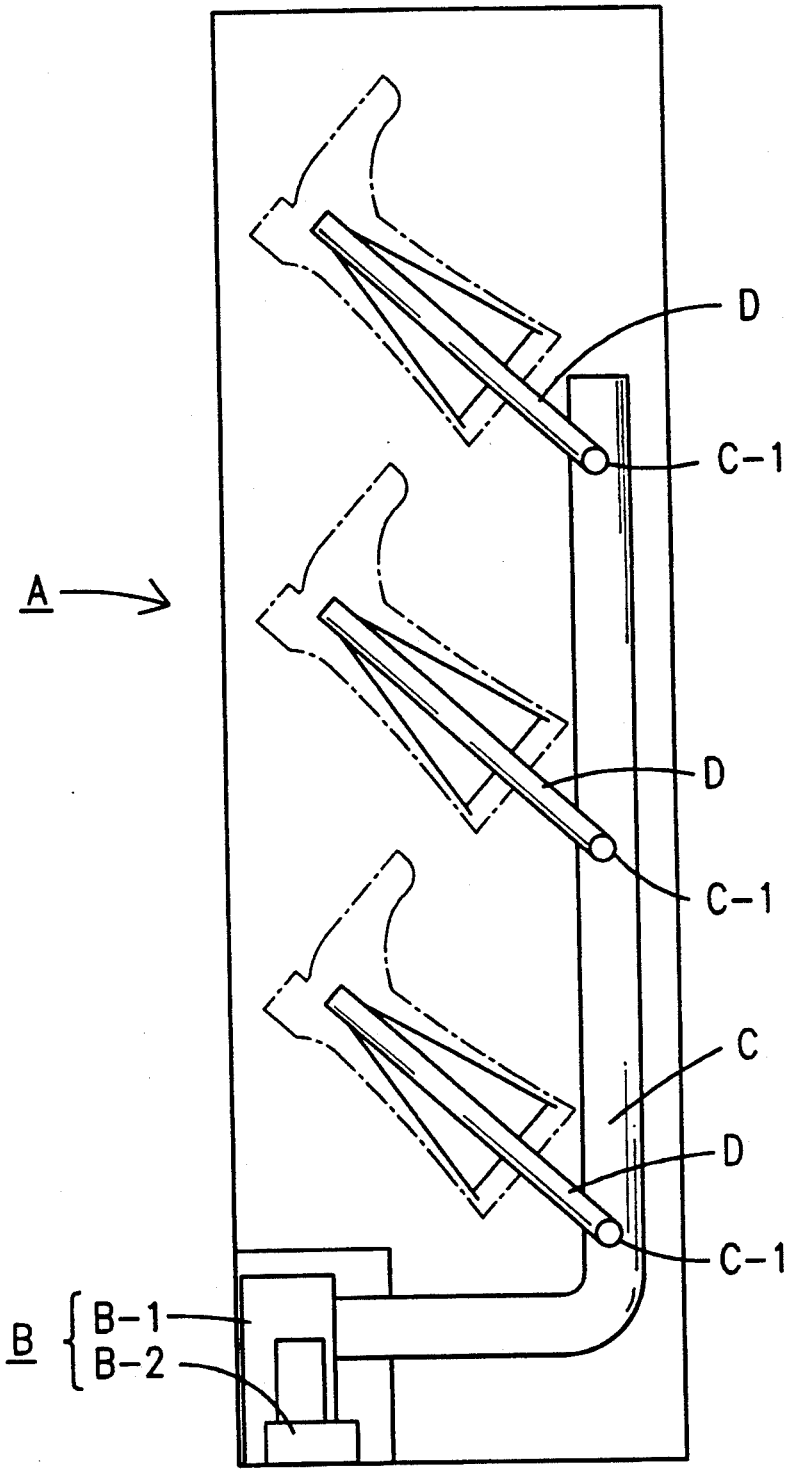
Fig. 16 PRIOR ART
FIG. 16 is a side view showing a prior example related to a boots dryer.
Figure 18:
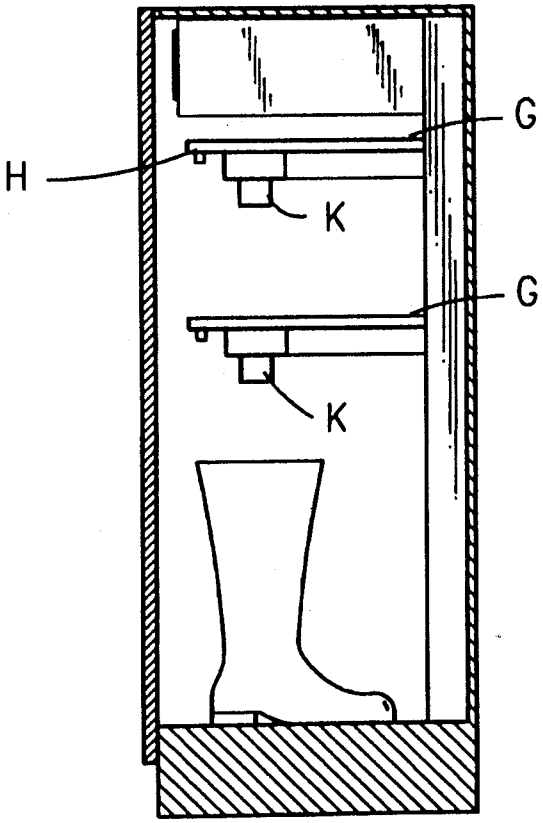
Fig. 18 PRIOR ART
FIG. 18 is a side view showing a prior shoes dryer shown in FIG. 17.
Figure 17:
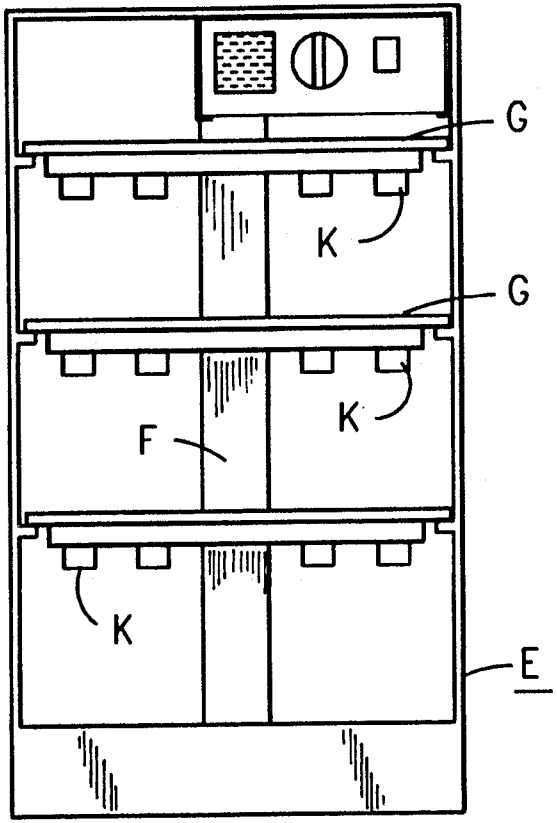
Fig. 17 PRIOR ART
FIG. 17 is a front view showing other prior example related to a shoes dryer.

FIG. 15 is a schematic representation of a drying apparatus for rubber boots and others related to the fourth embodiment of this invention. In this embodiment, the housing box (6) is formed in short and/or long forms by partition frames and the disinfectant spraying equipment (8) is connected in free communication with the low-temperature dehumidifier (7).

In this fourth embodiment, not only rubber boots but also, for example, golf bags, coats, and other outfits with various shapes can be freely stored, dried, and dehumidified.

This fourth embodiment is not limited to the example shown in FIG. 15 but may have the housing boxes (6) of, for example, the second and third embodiments formed in short and/or long forms with partition frames.

The drying apparatus for rubber boots and others (1) related to this invention can be installed not only in the workshop of factories as described above to dry rubber boots but also at ski grounds to dry ski boots or used for other various applications.

Test Examples

Now, test examples are enumerated to further clarify the effects of this invention.

(Test Example 1)

Using a drying apparatus for rubber boots and others (1) according to this invention shown in the above embodiment FIG. 7, the number of bacteria in rubber boots were measured before and after spraying disinfectant.

A disinfectant comprising the pyracetic acid solution, terpene, and nonionic surface active agent produced by the Ikari Disinfectant Co., Ltd. was prepared and filled in the disinfectant spraying equipment.

Of the housing boxes (6) of the drying apparatus for rubber boots and others (1), optional seven places (A-G) near the disinfectant spraying equipment and distant from the disinfectant spraying equipment were selected and the number of bacteria in the rubber boots were measured before and after 2-second disinfectant spraying.

With respect to the type of bacteria and measuring places, for the right toe, general viable bacteria were measured and for the left toe and heel, *Escherichia coli* were measured.

For the testing method of bacteria, using contact slides C (marketed by Gunze Ltd.) for general viable bacteria and contact slide GK-A (marketed by Gunze Ltd.) for *Escherichia coli,* the number of bacteria was measured at the specified places before and after disinfectant spraying in terms of the number of colonies after incubating at 36° C. for 48 hours.

The results are shown in Table 1.

TABLE 1

| | | The number of general viable bacteria spraying disinfectant | | The number of *Escherichia coli* spraying disinfectant | |
|---|---|---|---|---|---|
| | | before | after | before | after |
| A | toe | crowded | 4 | 2 | 0 |
| | heel | crowded | 2 | 4 | 0 |
| B | toe | crowded | 3 | 0 | 0 |
| | heel | crowded | 8 | 0 | 0 |
| C | toe | crowded | 4 | 0 | 0 |
| | heel | 147 | 1 | 0 | 0 |
| D | toe | crowded | 2 | 0 | 0 |
| | heel | 113 | 1 | 0 | 0 |
| E | toe | crowded | 16 | 1 | 0 |
| | heel | crowded | 7 | 0 | 0 |
| F | toe | crowded | 11 | 1 | 0 |
| | heel | crowded | 14 | 0 | 0 |
| G | toe | crowded | 8 | 0 | 0 |
| | heel | crowded | 4 | 0 | 0 |

What is claimed is:

1. An apparatus for drying rubber boots and other items, comprising:

a hollow housing having open front and rear walls;

said housing being subdivided into a plurality of housing boxes;

said housing including at least two rows of said housing boxes;

disinfectant spraying equipment means being disposed in open communication with a first preselected row of housing boxes at a first end thereof;

a supply air fan means disposed at said first end of said first preselected row of housing boxes, said supply air fan means being associated with said disinfectant spraying equipment means;

a suction fan means disposed at a second end of said first preselected row of housing boxes;

low temperature dehumidifying means being disposed in open communication with a second preselected row of housing boxes at a first end thereof;

a suction fan means disposed in open communication with said low temperature dehumidifying means, said suction fan means blowing air into the environment external to said hollow housing;

a supply air fan means positioned at a second end of said second preselected row of housing boxes;

each of said housing boxes being individually closed at its front and rear sides, each of said housing boxes having at least one openable door means individual to it;

each of said housing boxes having a floor means in the form of plural rods of narrow diameter; and means for maintaining the interior of said housing at a low temperature;

whereby an air flow pattern within said housing includes at least one return bend, said air flow pattern including a path of travel that begins at said first end of said first preselected row of housing boxes, continues to a second end of said first preselected row, executes said return bend, and flows from a second end of said second preselected row to said first end of said second preselected row and to the environment external to said housing.

2. The apparatus of claim 1, further comprising at least a third row of housing boxes, and wherein each row of housing boxes has a supply air fan means and a suction fan means at opposite ends thereof, wherein said rows of housing boxes collectively form plural columns of housing boxes, wherein said supply air fan means and suction fan means are disposed in columns at opposite ends of said housing, and wherein each column includes alternating supply air fan means and suction fan means along its vertical extent so that air flowing within said housing follows a path of travel including at least two return bends.

3. An apparatus for drying rubber boots and other items, comprising:

a hollow housing having open front and rear walls;

said hollow housing having a pair of vertically disposed end walls;

said hollow housing being subdivided into a plurality of housing boxes;

said plurality of housing boxes being arranged in plural rows and plural columns;

disinfectant spraying equipment means being disposed in open communication with a first preselected row of housing boxes at a preselected end thereof;

low temperature dehumidifying means being disposed in open communication with a second preselected row of housing boxes at a preselected end thereof;

each of said housing boxes being individually closed at its front and rear sides, each of said housing boxes having at least one openable door means individual to it;

each of said housing boxes having a floor means in the form of plural rods of narrow diameter;

a plurality of supply air fan means disposed at preselected ends of preselected rows of said housing boxes;

a plurality of suction fan means disposed at preselected ends of preselected rows of said housing boxes;

said plurality of supply air fan means and said plurality of suction fan means being disposed in a predetermined cooperative pattern to cause air flow within said plural rows of housing boxes to follow a predetermined path of travel that includes at least one return bend; and means for maintaining the interior of said housing at a low temperature.

4. The apparatus of claim 1, further comprising a vertically disposed air passageway means positioned at opposite ends of said housing so that each row of housing boxes has an air passageway means disposed at its opposite ends, and wherein each air passageway means is positioned outwardly of said plurality of supply air fan means and said plurality of suction fan means so that each return bend executed by said air as it flows through said housing is executed outwardly of said plurality of supply air fan means and said plurality of suction fan means and inwardly of said housing end walls.

5. The apparatus of claim 3, further comprising a vertically disposed air passageway means positioned at opposite ends of said housing so that each row of housing boxes has an air passageway means disposed at its opposite ends, and wherein each air passageway means is positioned outwardly of said plurality of supply air fan means and said plurality of suction fan means so that each return bend executed by said air as it flows through said housing is executed outwardly of said plurality of supply air fan means and said plurality of suction fan means and inwardly of said housing end walls.

6. The apparatus of claim 1, further comprising means for causing air to flow in a vertical direction through each column of housing boxes.

7. The apparatus of claim 3, further comprising means for causing air to flow in a vertical direction through each column of housing boxes.

8. The apparatus of claim 6, wherein said means for causing air to flow in a vertical direction is a plurality of supply air fan means, wherein each supply air fan means of said plurality of supply air fan means is removably mounted, and wherein each of said supply air fan means is configured so that it receives power only when it is fully installed.

9. The apparatus of claim 7, wherein said means for causing air to flow in a vertical direction is a plurality of supply air fan means, wherein each supply air fan means of said plurality of supply air fan means is removably mounted, and wherein each of said supply air fan means is configured so that it receives power only when it is fully installed.

10. The apparatus of claim 1, further comprising means for supplying heat to each of said housing boxes, wherein said rods that define the floor means of each housing box are hollow, and said means for supplying heat including a heating element disposed within a hollow interior of said rods.

11. The apparatus of claim 3, further comprising means for supplying heat to each of said housing boxes, wherein said rods that define the floor means of each housing box are hollow, and said means for supplying heat including a heating element disposed within a hollow interior of said rods.

12. The apparatus of claim 1, wherein each supply air fan means and each suction fan means is offset from the center of its associated row of housing boxes so that air flows therethrough substantially unimpeded when items to be dried are placed within the individual housing boxes.

13. The apparatus of claim 3, wherein each supply air fan means and each suction fan means is offset from the center of its associated row of housing boxes so that air flows therethrough substantially unimpeded when items to be dried are placed within the individual housing boxes.

14. The apparatus of claim 1, wherein said low temperature is maintained between twenty degrees Centigrade and forty degrees Centigrade.

15. The apparatus of claim 3, wherein said low temperature is maintained between twenty degrees Centigrade and forty degrees Centigrade.

16. The apparatus of claim 1, further comprising means for partitioning said housing into housing boxes of differing configurations so that items of differing sizes may be stored, dried and dehumidified in said housing.

17. The apparatus of claim 3, further comprising means for partitioning said housing into housing boxes of differing configurations so that items of differing sizes may be stored, dried and dehumidified in said housing.

* * * * *